US006151727A

United States Patent [19]

Lofquist, Jr.

[11] Patent Number: 6,151,727

[45] Date of Patent: Nov. 28, 2000

[54] BATHTUB FOR PERSONS WITH DISABILITIES

[76] Inventor: Alden A. Lofquist, Jr., 103 Sand River Ct., Aiken, S.C. 29801

[21] Appl. No.: 09/054,042

[22] Filed: Apr. 2, 1998

Related U.S. Application Data

[60] Provisional application No. 60/043,366, Apr. 2, 1997.

[51] Int. Cl.[7] ..... A47K 3/022

[52] U.S. Cl. ..... 4/555; 4/556; 4/557

[58] Field of Search ..... 4/555, 556, 554, 4/557

[56] References Cited

U.S. PATENT DOCUMENTS

| | | | |
|---|---|---|---|
| D. 285,346 | 8/1986 | Sween . | |
| D. 351,018 | 9/1994 | Bourgraf et al. . | |
| 3,864,762 | 2/1975 | Finch et al. | 4/555 |
| 4,034,424 | 7/1977 | Budlong | 4/556 X |
| 4,546,506 | 10/1985 | Houle et al. | 4/555 |
| 4,672,693 | 6/1987 | Schenstrom | 4/555 |
| 4,796,312 | 1/1989 | Corlew | 4/555 |
| 4,953,241 | 9/1990 | Williams | 4/556 |
| 5,255,400 | 10/1993 | Sween . | |
| 5,446,929 | 9/1995 | Sills et al. | 4/555 |
| 5,463,780 | 11/1995 | McAllister et al. | 4/555 X |
| 5,701,614 | 12/1997 | Appleford et al. | 4/555 |

*Primary Examiner*—Henry J. Recla
*Assistant Examiner*—Kathleen J. Prunner
*Attorney, Agent, or Firm*—Maria Reichmanis

[57] ABSTRACT

A bathtub apparatus for persons with disabilities, including a removable front panel and an elevated bed that allows direct lateral access by the user. The bed of the bathtub is elevated above the bathroom floor, approximately at the height of a chair, toilet seat, or standard bathtub front rail. The relative movement of the front panel/wall can be accomplished in a number of different ways, as can sealing between the front panel and the stationary parts of the bathtub. In one embodiment of the invention, the bathtub can be installed above an existing conventional bathtub, thereby avoiding the necessity of removing the old tub before installing the new one. The bathtub can be used in private homes, hotels/motels, and other locations; it can be used by persons with disabilities that would otherwise preclude them from bathing unattended or unassisted.

18 Claims, 4 Drawing Sheets

BATHTUB FOR PERSONS WITH DISABILITIES

This application claims benefit of Provisional application Ser. No. 60/043,366 filed Apr. 2, 1997.

BACKGROUND OF THE INVENTION

1. Field of the Invention:

The present invention relates to bathtubs and bathtub/shower combinations that satisfy the needs of persons with temporary or permanent disabilities that render use of a conventional bathtub difficult or impossible. In particular, the present invention relates to a bathtub apparatus having a movable front panel and an elevated bed or seat, so that the bathtub can be accessed directly from a wheelchair with only lateral movement.

2. Discussion of Background:

Existing bathtubs and bathtub/shower combinations come in a variety of sizes, types and configurations, ranging from older cast iron tubs that are raised on feet, to newer tubs that have oval or rounded rectangular tub recessions set into the tub structure at an angle. Some tubs have built-in Jacuzzi™ or other whirlpool units, heaters, and other devices that add to the user's comfort and enjoyment.

Despite the growing awareness that large numbers of people simply cannot use conventional bathroom fixtures safely (or even use them at all), essentially all present-day bathrooms contain bathtubs designed for the hypothetical "average" adult. Whatever their age or type, conventional bathtubs have raised walls that the user must step over, or steps that the user must climb in order to use the tub. Many people have temporary or permanent disabilities that render the use of a conventional bathtub difficult or impossible, even with the assistance of a nurse or other caregiver. (As used herein, the term "disability" refers to any condition that hinders a person's access to conventional bathtubs and/or showers. Such disabilities include paraplegia, missing limbs, fractures, osteoporosis, impaired balance, arthritis, multiple sclerosis, and so forth.) In the United States alone, over six million people routinely use a mobility-assisting device such as crutches, canes, wheelchairs, scooters, and the like; over four million people have difficulty taking a bath or shower; and almost three million need personal assistance in taking a bath or shower. Thus, there is a growing market for universally-accessible bathroom designs, a market that is anticipated to parallel the increase in the average age of the U.S. population and growing awareness of the needs of disabled persons and the elderly.

A variety of devices are available to assist disabled persons in bathing, showering, etc., ranging from non-skid surfaces and sturdy grab bars to bath lifts, fixed or swiveling bathtub seats, and tubs with access doors. Presently-available devices include tubs with access doors such as those made by the Silcraft Corporation of Traverse City, Mich. and the Kohler Company of Kohler, Wis. Bathtub designs are shown in U.S. Pat. Nos. D 351,018, D285,346, and 5,255,400. In addition, "walk-in" and "wheel-in" showers are becomingly increasingly common in hospitals, nursing homes, and even private homes designed for accessibility. However, showers cannot duplicate the therapeutic effects of soaking in a bathtub, and many people simply prefer tub baths to showers. Some estimates suggest that the United States market for accessible bathtubs could easily approach 30,000 or more per year. However, it is believed that presently available bathtub designs do not satisfactorily address the needs of the large and growing population of individuals who cannot use a conventional bathtub.

This invention relates generally to the design and construction of bathtubs and bathtub/shower combinations, and more specifically to the design and construction of bathtubs and bathtub/shower combinations that address the unique needs of persons with disabilities. Appropriate bathtub designs for this group would not only help such persons in an important activity, but also reduce a major occupational hazard of nurses and other caregivers: sprained/strained backs and shoulders that result from assisting patients into and out of conventional bathtubs. The emphasis of the invention is to provide a bathtub or bathtub/shower combination that assists people with disabilities to care for themselves and maintain an independent lifestyle (the terms "bathtub," "bathtub/shower," "bathtub apparatus" and "bathtub/shower apparatus" are used interchangeably in the following specification).

A bathtub apparatus that addresses these needs should have the following features:

1. As a baseline criterion, the bathtub must be accessible, without assistance, by a person in a wheelchair.

2. The bathtub should preferably be dimensioned to be comparable to a full-sized, soak-bath type bathtub, and accommodate virtually everyone (except perhaps, a small percentage of the population due to size or weight considerations). The user should be able to access and control the water temperature, flow rate, and drain.

3. The bathtub should be capable of being installed in a typical bathroom, either as a new installation or retrofitted to an existing unit.

4. The bathtub should be usable by all persons. Non-disabled users (that is, those without disabilities that restrict their access to conventional tubs and showers) should be able to bathe and/or shower in a normal manner, disabled users should be able to bathe and/or shower with minimal risk of falling.

5. The tub must be cost-effective and easily installed.

Designing such a bathtub apparatus requires an understanding that, for a person with disabilities, bathing—or being bathed—involves not just the act of bathing itself (i.e., the act of immersing a person in a liquid for cleaning). It also encompasses people-handling in the psychological and physiopsychological sense: understanding and accommodating the desire for independence, dignity, safety, and security, combined in many instances with a reluctance to ask others for help.

SUMMARY OF THE INVENTION

According to its major aspects and broadly stated, the present invention is a bathtub apparatus having a floor panel, a wall panel, and a movable front panel or door that can be opened to permit access into (and out of) the bathtub. One end of the floor panel forms a stationary tub bed or seat on which the user's back or buttocks rest; the other end forms a foot well. The wall panel, which is preferably integrally formed with the floor panel, may include head, rear, and foot panels analogous to those found in conventional bathtubs. The floor panel, the wall panel, and the movable front panel cooperate to form a liquid-containing enclosure. The apparatus, hereinafter referred to as "Alden's Tub" or the "ATI Tub," permits direct lateral movement by the user to and from the tub bed: a nondisabled user can access the apparatus directly by stepping into the open tub, a disabled or nondisabled user can sit down on the seat and move his feet into the tub; a disabled user can slide from a wheel-chair to the seat. These modes of access are referred to herein as "direct access," "direct lateral access," or "direct lateral movement."

The apparatus can be provided as a stand-alone model which is generally similar to a conventional bathtub/shower; a drop-in model which is installed similarly to a kitchen sink in a cut-out or recess in a kitchen counter, but is otherwise similar to the stand-alone type; and a portable model which can be installed above an existing conventional bathtub such as those typically found in private homes or motel rooms.

Its versatility and cost-effectiveness constitute major features of the present invention. Most bathrooms, either new or existing, have been designed to utilize either right-handed or left-handed bathtubs (i.e., bathtubs having plumbing fixtures and drainage either at the right or left side as the user faces the tub); some have centrally located plumbing. Existing bathtubs and bathtub/shower combinations come in a wide variety of sizes, types and configurations, some having built-in Jacuzzi™ or other whirlpool units, water heaters, and other devices intended to add to the user's comfort and convenience. The ATI Tub can be installed instead of another type of bathtub; alternatively, it can be retro-fitted—permanently or temporarily—to the vast majority of presently-existing bathtubs. Because the ATI Tub has no "handedness," it can be used with either left-handed or right-handed plumbing fixtures.

As will be seen in the Detailed Description, the ATI Tub is simpler to manufacture and requires less materials and labor than the other designs, therefore resulting in a more cost-effective product. The ability to quickly and easily install the ATI Tub over an existing conventional bathtub reduces installation costs, since there is no need to demolish and remove the old tub before installing the new one.

An important feature of the present invention is the movable front panel which permits direct lateral access by the user. The front panel may extend the full length of the ATI Tub or only a portion of the length, and may take a number of different forms to permit it to be moveable and sealable relative to the stationary parts of the tub as will be described in detail below.

Depending on the needs and preferences of the user, the front panel may be bottom-hinged for a fold-up/fold down motion, side-hinged for lateral swing-out/swing-in motion, a banker's roll-top desk type of panel, a pivotable panel that pivots up or down about a pivot point away from the panel itself, or a parallelogram type panel utilizing two lever arms and pivot points at the ends of the tub. A variety of different type of seals may conveniently be used with the invention, including but not limited to compression-type seals such as are used with refrigerator doors, pneumatically-inflatable or hydraulically-inflatable seals, and diaphragm-type seals.

Another feature of the present invention is the elevated tub bed, which is at a comfortable seating height when the bathtub is installed. Typical heights are approximately 15"–16" (about 38–41 cm) above floor level, although heights outside this range may also be useful. This feature permits a person to move laterally to and from the ATI Tub from a wheelchair, for example, by sliding from the wheelchair onto the tub bed.

Still another feature of the present invention is the foot well, which is preferably located at the same end of the ATI Tub where the water valves, nozzle, and drain would be located in a conventional bathtub. The foot well may be approximately 24"×24" (about 61×61 cm) in horizontal dimensions and approximately 12" (about 30 cm) deep, and serves several functions: (a) it increases the effective length of the ATI Tub for tall users so that all portions of the body, including the knees, can be submerged; and (b) it permits non-disabled users to both bathe and shower in a conventional manner.

Other features and advantages of the present invention will be apparent to those skilled in the art from a careful reading of the Detailed Description of a Preferred Embodiment presented below and accompanied by the drawings.

DETAILED DESCRIPTION OF A PREFERRED EMBODIMENT

Figure 1:
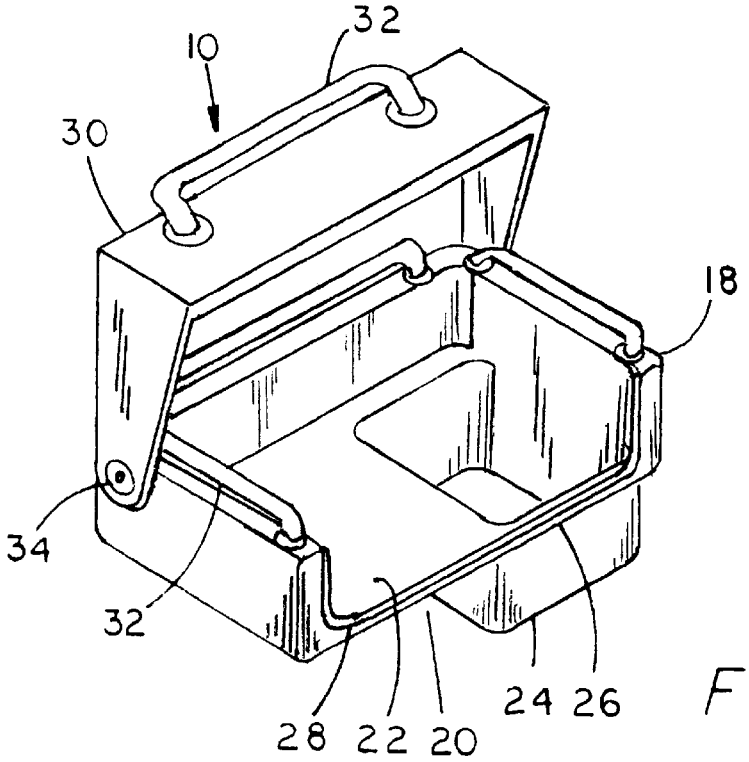
FIG. 1 is a schematic, isometric view of a portable bathtub apparatus according to a preferred embodiment of the present invention.

In the following description, reference numerals are used to identify structural elements, portions of elements, or surfaces in the drawings, as such elements, portions or surfaces may be further described or explained by the entire written specification. For consistency, whenever the same numeral is used in different drawings, it indicates the same element, portion, surface and area as when first used. As used herein, the terms "horizontal," "vertical," "left," "right," "up," "down," as well as adjectival and adverbial derivatives thereof, refer to the relative orientation of the illustrated structure as the particular drawing figure faces the reader. It should be understood that only those components having particular functional importance or that would not otherwise be identified have been assigned reference numerals.

Referring now to FIG. 1, there is shown a bathtub apparatus 10 ("Alden's Tub" or "ATI Tub") according to a preferred embodiment of the present invention. Bathtub 10 includes a wall panel 18, and a floor panel 20 with a tub bed or seat portion 22 and a recessed foot well portion 24. Wall 18 includes a head end wall, rear side wall, and foot end wall analogous to those found in conventional bathtub installations, being readily identifiable and therefore not numbered.

Foot well 24 has a drain 26, sealable with a conventional elastomeric drain plug or some other suitable means. Tub bed 22 and foot well 24, together with wall 18, are stationery when bathtub 10 is installed for use, whether the installation is temporary or permanent. Tub bed 22 (and foot well 24, if desired) may have textured surfaces for increased traction. Bathtub 10 is illustrated schematically: the tub may have generally flat, rectangular walls as shown herein, or gently curved edges and surfaces to further user comfort and esthetic appeal. If desired, tub bed 22 may be contoured to form a comfortable seat for the user.

A pivotable door or front panel 30 is connected to the stationary portions of bathtub 10 by any suitable means, preferably by two off-center cam pivots 34 located at each end of front panel 30 as will be described further below. A seal (for example, the seal shown schematically as 28) seals front panel 30 to wall 18 when the panel is in a closed position. Front panel 30 may have handles, hand rails, or grab bars permanently attached thereto, such as a grab bar 32. Additional hand rails, of any convenient size and design, may be attached to the side walls and rear wall of bathtub 10. For stability, grab bars 32 are preferably fixed in position.

Figure 2:
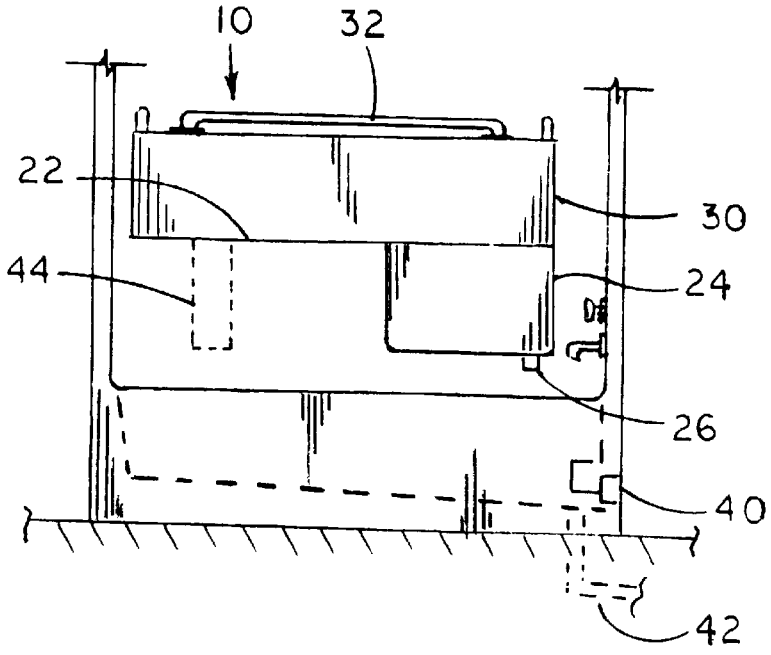
FIG. 2 is an orthographic view of the bathtub apparatus of FIG. 1, shown positioned above an existing bathtub/shower combination in preparation for installation.

FIG. 2 shows the bathtub of FIG. 1 suspended over a conventional bathtub or combination bathtub/shower 40 having a permanently-installed drain 42 (the water supply nozzle and valving for bathtub 40 are indicated but not numbered). Bathtub includes pivotable front panel 30, as well as foot well 24, drain 26, and the other above-described portions of the ATI Tub.

Figure 3:
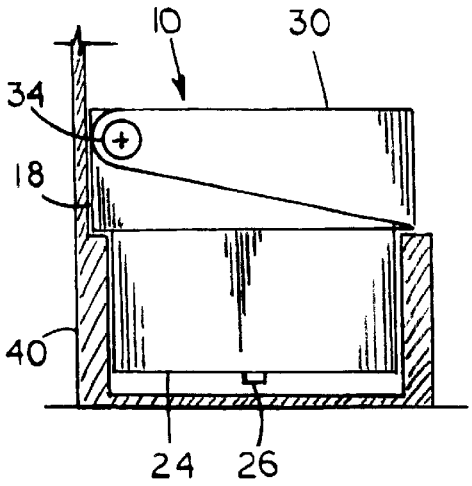
FIG. 3 is an end elevation view of the bathtub apparatus of FIG. 1, showing the bathtub installed in an existing bathtub and supported by the front and rear panels or ledges thereof.

An optional auxiliary rear support 44 is shown schematically in FIG. 2. Support 44 may be required when bathtub 10 cannot readily be supported in position by pre-existing bathtub ledges and the like (as shown in FIG. 3 and discussed under FIG. 4).

In use, front panel 30 is raised to the upright, "open" position shown in FIG. 1. The user moves, with or without assistance, to a sitting position with his or her buttocks resting on tub bed 22 and feet in foot well 24. From a standing position, an ambulatory user may simply step into bathtub 10 and sit down on tub bed 22. Alternatively, to minimize the risk of falling while stepping into bathtub 10, he may sit down on bed 22, then swing his feet into foot well 24. A user seated in a wheelchair pulls himself parallel to bathtub 10 at tub bed 22, moves the arm rest of the chair out of the way, and, holding onto the wheelchair for support if needed, slides onto tub bed 22. Once seated on tub bed or seat 22, he lifts his legs, one at a time, into foot well 24. Thus, tub bed 22 combines the functions of a seat and a transfer surface that a mobility-impaired person can use for entering and leaving bathtub 10. Tub bed 22 preferably meets the ANSI (American National Standards Institute) standard for a transfer surface (i.e., at least approximately 15" (about 38 cm) deep).

Front panel 30 is then lowered and locked into its "closed" position (as indicated in FIG. 2), and a drain seal put into drain 26. With front panel 30 in the closed position, front panel 30, wall 18, and floor 20 form a substantially water-tight (i.e., fluid-tight, liquid-tight) enclosure. Hot and cold water is introduced into bathtub 10 by means of a hose and handheld shower head or other suitable plumbing (such plumbing is not a part of this patent application).

Upon completion of bathing, drain 26 is opened and water from bathtub 10 drains into existing tub 40 and drain 42. Front panel 30 is again raised. The user exits bathtub 10 by standing and moving out of the bathtub, or by sliding from seat 22 to a waiting wheelchair. If the user requires assistance, that assistance is substantially enhanced because a caregiver can quickly and easily operate front panel 30 and has ready access to the interior of bathtub 10. This feature facilitates assistance by a family member, thereby delaying the necessity for hiring professional caregivers or moving to a nursing home.

FIG. 3 is an end elevation view of an ATI Tub according to the present invention installed in an existing bathtub as described above, shown fully inserted into the existing tub 40 and supported along its sides by the front panel and rear ledge of the existing tub (Tub 40 is shown in cross-section). Pivotable front panel 30 is shown in its closed position.

Figure 4:
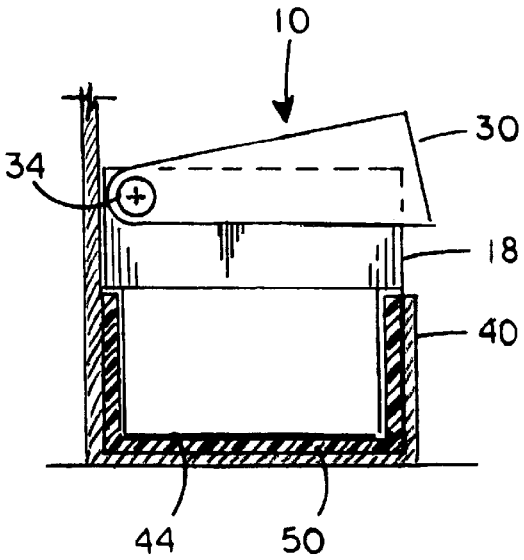
FIG. 4 shows the bathtub of FIG. 1 installed in an existing bathtub in which there is no rear ledge for support, therefore requiring a supplemental filler material between the ATI Tub and the bed and side walls of the existing tub.

FIG. 4 is an end elevation view of an ATI Tub with an auxiliary rear support 44 installed in an existing bathtub 40 that lacks a rear ledge for support. In this case, a filler material or shims may need to be installed between the bed and sidewalls of tub 40 and support 44 and foot well 24 of bathtub 10. The filler material may take any of several different forms. By way of example, thin-walled, flexible plastic sleeves may be positioned under support 44 and foot well 26, and chemicals injected therein to form a foamed-in-place, expandable plastic filler material (indicated generally as 50). However, it will be understood by those of ordinary skill that other types of filler or shim may also be suitable for use with the invention.

Figure 5A:
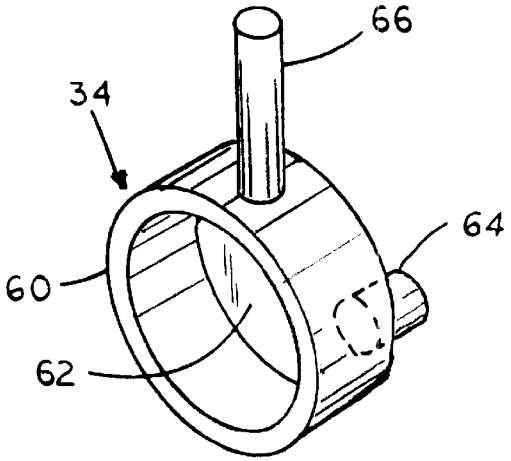
FIG. 5A is an isometric view of the off-center cam used as a pivot point for the front panel of the bathtub of FIG. 1.
Figure 5B:
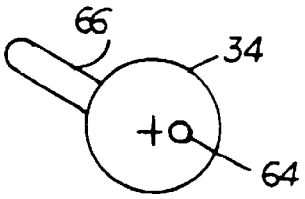
FIGS. 5B and 5C show the cam of FIG. 5A in "closed" and "open" positions, respectively.
Figure 5C:
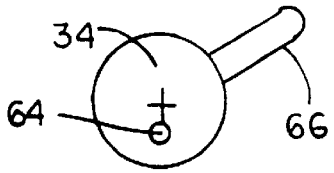
Figure 5D:
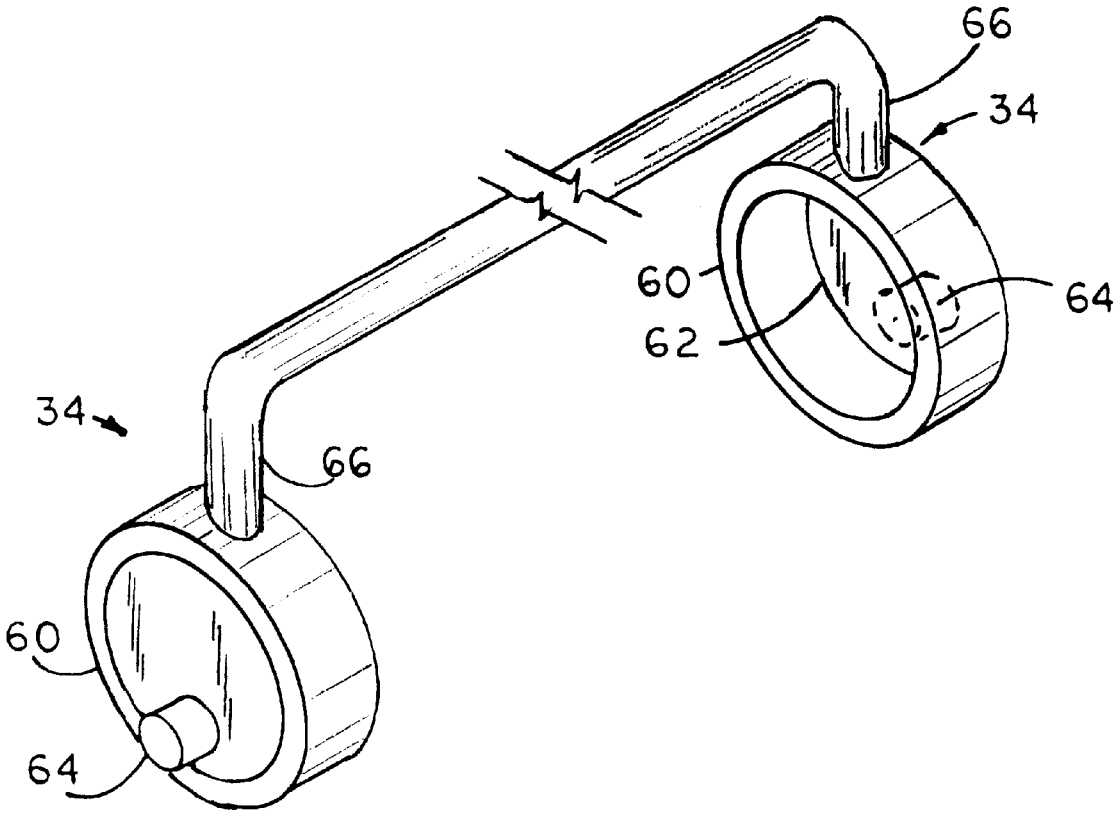
FIG. 5D shows two off-center cam pivots connected by a lever arm.

Turning now to FIGS. 5A–C, there are shown detail views of off-center cam pivot 34 of FIG. 1. Pivot 34 includes a generally circular outer body pivot 60, a rear plug 62, and an off-center pivot 64 which is inserted into a suitable bushing in the wall of bathtub 10. In a preferred embodiment of the present invention, bathtub 10 includes two such pivots 34, one at each end of front panel 30 (as shown schematically in FIG 5D). A rigid operating lever arm 66 in the form of an inverted "U" connects the two pivots 34, causing the pivots to operate essentially in unison when lever arm 66 latches or unlatches front panel 30 against bathtub 10. However, other pivot means may also be useful for the practice of the invention.

Figure 6:
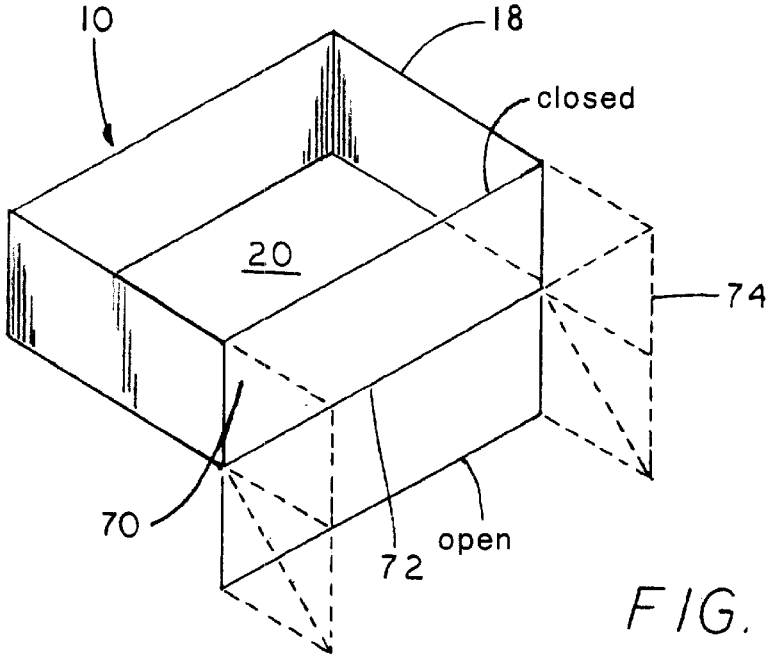
FIG. 6 is an isometric view of a bottom-hinged, fold-down front panel utilizing folded diaphragms for leak-proof sealing, showing the panel in the "closed" position.

FIG. 6 shows another preferred embodiment of the invention, wherein a front panel 70 is hingedly connected to the stationary portions of bathtub 10 at a lower edge 72. Panel 70 is movable between the "open" and "closed" positions indicated in FIG. 6. Sealing of panel 70 to bathtub 10 may be accomplished by any convenient means. By way of example, an elastomeric strip may cover the hinge, and be attached to both tub bed 22 and front panel 70. Alternatively, folded elastomeric sheet diaphragms 74 may be connected between the front and the end walls of bathtub 10. Latching of front panel 70 can be accomplished in a number of different ways within the spirit of the present invention.

Figure 7A:
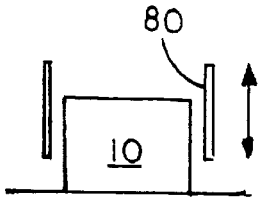
FIGS. 7A–E are schematic, end elevation views of moveable front panels usable with the invention.
Figure 7B:
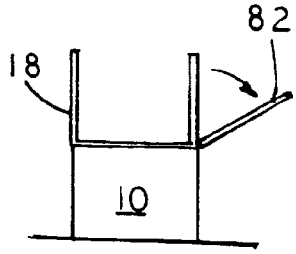
Figure 7C:
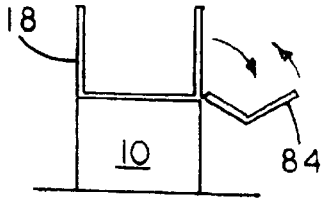
Figure 7D:
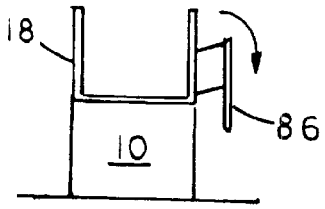
Figure 7E:
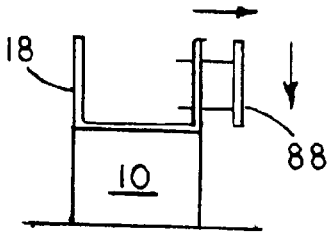

FIGS. 7A–7E illustrate schematically a variety of additional front panel or door designs usable with the present invention. By way of example, FIG. 7A shows the operation of a front panel 80 that includes a rolling diaphragm-type seal. FIG. 7B shows a bottom-hinged fold-down front panel 82 such as that shown in FIG. 6. Alternatively, front panel 82 may be side-hinged for lateral swing-out/swing-in motion if preferred. Other designs include a folding panel 84 (FIG. 7C), a pantograph-type panel 86 (FIG. 7D), and a two-way slide panel 88 (FIG. 7E).

From the above narrative, a number of variations and alternatives may be considered as lying within the scope of the present invention. It will be clear to those skilled in the art that factors such as the particular application affect the design approach. The following discussion outlines a few of the major application factors that may impact the design approach.

One factor is the intended market segment for the ATI Tub. Potential markets include hotel and motel chains, retirement and assisted care homes, nursing homes and rehabilitation facilities, hospitals, and private homes. For all of these markets, the purchase of a bathtub for either permanent or temporary installation is an option. Other options include renting or leasing a bathtub to meet a short-term need. A bathtub according to the present invention can help businesses satisfy the requirements of the Americans With Disabilities Act (ADA). The ADA addresses discrimination against individuals on the basis of a physical or mental handicap; it is designed to end physical barriers in the use of public accommodations and transportation.

Another factor is the selection of a particular design. The ATI Tub may be provided as a "stand-alone" model which is similar to a conventional bathtub/shower (but with the above-described features). Alternatively, the ATI Tub may take the form of a "drop-in model" which can be installed in a suitably-dimensioned recess in a platform, in a manner similar to a kitchen sink in a cut-out or recess in a kitchen counter. These models, which replace a conventional bathtub installation, may be preferred for new or remodeled bathrooms designed for universal accessibility. Alternatively, a portable model can be installed above an existing conventional bathtub such as those commonly found in private homes, hotels and motels, hospitals, nursing homes, etc. While all models of the ATI Tub may be manufactured in any desired size and color, a few standard sizes are preferable from the standpoint of manufacturing and market economics.

A bathtub according to the present invention may be made of any suitable materials, preferably of materials that can be molded by techniques known in the art of bathtub manufacturing. Suitable techniques include spray-molding, roto-molding, blow-molding, compression molding, and injection molding. Lightweight, durable materials such as acrylic resins and other plastics, Fiberglas™, and reinforced plastics (i.e., composites composed of a thermosetting or thermoplastic resin and fibers, filaments, or whiskers of glass, metal, boron, aluminum silicate, etc.) are broadly suitable for use with the invention.

As noted above, a variety of movable front panels may be used with the invention, including but not limited to a bottom-hinged panel for a fold-up/fold down motion, a side-hinged panel for lateral swing-out/swing-in motion, a banker's roll-top desk type of panel, a pivoted panel permitting the movable panel to pivot up or down about a pivot point away from the panel itself, and a parallelogram-type panel utilizing two lever arms and pivot points at the ends of the bathtub. These may be used with all of the above-described models of the ATI Tub, subject to physical restrictions that may exist within any particular bathroom.

A variety of seals are usable with the invention, including but not limited to compression-type seals such as those used for refrigerator doors, pneumatically-inflatable or hydraulically-inflatable seals, and diaphragm-type seals. For example, diaphragm seals such as folded sheets, fan-fold sheets, or rolling diaphragm seals may be used on bottom-hinged or side-hinged panels to make the seal leak-proof Most bathrooms, either new or existing, have been designed to utilize either right-handed or left-handed bathtubs, that is, with plumbing fixtures and drainage either at the right or left as a person faces the tub, as well as centrally located plumbing. Existing bathtubs and bathtub/shower combinations come in a variety of sizes, types and configurations, ranging from older cast iron tubs that are raised on feet, to newer tubs that have oval or rounded rectangular tub recessions set into the tub structure at an angle. The ATI Tub can be used in essentially all of the above-noted configurations, contributing to both interchangeability and economy in production. The tub has no handedness per se, thus, it can readily be installed for use with existing left-handed or right-handed plumbing fixtures.

A bathtub apparatus according to the present invention is believed to be simpler to manufacture, and require less materials and labor than the other designs for accessible bathtubs, therefore resulting in a less expensive product. Furthermore, the portable model of the invention can be installed quickly and easily over an existing conventional bathtub. The principal advantages of portability are two-fold: the reduced costs associated with not having to remove an existing bathtub and permanently install a new tub, and the capability to quickly (and, if need be, temporarily) retrofit the ATI Tub to an existing installation. For instance, a portable ATI Tub can be installed in a motel room bath where a customer may only need the tub for a night or two, or in a private home where a resident or guest may need such a tub for a short period or even permanently.

Based on assessments of existing companies that produce bathtubs for persons with disabilities, there are no known products that compete with the ATI Tub concepts, and therefore the hotel/motel and the private home markets. The existing market (hotels and motels, hospitals, nursing homes, private homes, etc.) is estimated at more than 150,000 units over a period of five years. However, the market for accessible design is anticipated to increase substantially over the coming years, paralleling the increase in the average age of the U.S. population and growing awareness of the needs of disabled persons and the elderly.

It will be apparent to those skilled in the art that many changes and substitutions can be made to the preferred embodiment herein described without departing from the spirit and scope of the present invention as defined by the appended claims.

What is claimed is:

1. A bathtub, comprising:

a floor panel;

a wall panel attached to said floor panel, said wall panel including a head end wall, a rear side wall, and a foot end wall, said wall panel and said floor panel defining a bathtub enclosure with an opening;

a door panel;

means for pivotably securing said door panel to said head end wall and said foot end wall adjacent to said rear wide wall of said enclosure, said securing means operable to pivot said door panel from a first position above said enclosure wherein a user can access said enclosure through said opening to a second position wherein said door panel closes said opening; and means for sealing said door panel to said enclosure so that said enclosure is substantially water-tight when said door panel is in said second position.

2. The bathtub as recited in claim 1, further comprising drain means formed in said floor panel.

3. The bathtub as recited in claim 1, wherein said floor panel further comprises a seat portion and a foot portion, said seat portion being above said foot portion.

4. The bathtub as recited in claim 1, wherein said door panel has a first end and a second end, and wherein said securing means further comprises a pair of off-center cam pivots, one of said pair of pivots at each end of said door panel.

5. The bathtub as recited in claim 1, wherein said wall panel is integrally formed with said floor panel.

6. The bathtub as recited in claim 1, wherein said securing means further comprises a pivotable connector.

7. The bathtub as recited in claim 1, further comprising support means for installing said enclosures on an existing bathtub.

8. The bathtub as recited in claim 1, wherein said enclosure is molded of a material selected from the group consisting of plastic, acrylic resin, reinforced plastic, thermosetting resin, thermoplastic resin, and composite materials.

9. A bathtub, comprising:

a floor panel having a perimeter, said floor panel having a seat portion and a foot portion;

at least one wall panel attached to said floor panel along a major portion of said perimeter so that said at least one wall panel and said floor panel form a bathtub enclosure having an access opening;

drain means in said floor panel;

a front panel having a front wall and two spaced-apart side walls;

means for pivotably attaching said side walls of said front panel to said one wall panel at a location opposite said access opening, said attaching means operable to move said front panel from an open position wherein said front panel is above said enclosure to a closed position wherein said front panel closes said access opening; and means for sealing said front panel to said enclosure so that said enclosure is substantially water-tight when said front panel is in said closed position.

10. The bathtub as recited in claim 9, wherein said at least one wall panel further comprises a head end wall, a rear side wall, and a foot end wall.

11. The bathtub as recited in claim 9, wherein said attaching means further comprises a pair of off-center cam pivots, one of said pair of pivots at each side wall of said front panel.

12. The bathtub as recited in claim 9, wherein said at least one wall panel is integrally formed with said floor panel.

13. The bathtub as recited in claim 9, further comprising at least one grab bar attached to said wall panel.

14. The bathtub as recited in claim 9, further comprising at least one grab bar attached to said front panel.

15. The bathtub as recited in claim 9, wherein said floor panel, said at least one wall panel, and said wall panel are made of plastic, acrylic resin, Fiberglas™, or reinforced plastic.

16. The bathtub as recited in claim 9, wherein said attaching means further comprises a pair of pivotable connectors.

17. The bathtub as recited in claim 9, wherein said foot portion is recessed.

18. The bathtub as recited in claim 9, wherein said enclosure is molded of a material selected from the group consisting of plastic, acrylic resin, reinforced plastic, thermosetting resin, thermoplastic resin, and composite materials.

* * * * *